US005472245A

United States Patent [19]

Meske et al.

[11] Patent Number: 5,472,245

[45] Date of Patent: Dec. 5, 1995

[54] WARP BEAM FLANGE ASSEMBLY AND METHOD OF MANUFACTURE

[75] Inventors: Berthold Meske; Rainer Meske, both of Schoeppenstedt, Germany

[73] Assignee: ABR Metalguss GmbH, Schoeppenstedt, Germany

[21] Appl. No.: 265,928

[22] Filed: Jun. 27, 1994

[30] Foreign Application Priority Data

Jun. 26, 1993 [DE] Germany ..... 9309503 U

[51] Int. Cl.[6] ..... D02H 13/28; D02H 13/32

[52] U.S. Cl. ..... 285/414; 285/405; 285/92; 411/291; 411/432; 242/118.5; 242/118.62

[58] Field of Search ..... 285/405, 414, 285/92; 411/290, 291, 432, 433; 242/118.5, 118.6, 118.61, 118.62

[56] References Cited

U.S. PATENT DOCUMENTS

| | | | |
|---|---|---|---|
| 171,898 | 1/1876 | Wiles | 411/291 |
| 518,474 | 4/1894 | Wallace | 411/230 |
| 609,144 | 8/1898 | Goddin | 411/291 |
| 1,850,917 | 3/1932 | Browne | 411/275 |
| 2,409,204 | 10/1946 | Gall | 411/291 |
| 3,782,655 | 1/1974 | Moser | 242/118.5 |
| 4,012,009 | 3/1977 | O'Malley | 242/118.62 |
| 4,557,652 | 12/1985 | Lundgren | 411/291 |
| 5,069,587 | 12/1991 | Levenstein | 411/432 |

FOREIGN PATENT DOCUMENTS

| | | | |
|---|---|---|---|
| 0506998 | 10/1992 | European Pat. Off. . | |
| 525980 | 9/1970 | Switzerland . | |
| 634974 | 3/1950 | United Kingdom | 242/118.5 |
| 701696 | 12/1953 | United Kingdom | 242/118.5 |
| 953144 | 3/1964 | United Kingdom . | |

*Primary Examiner*—Eric K. Nicholson
*Attorney, Agent, or Firm*—Foley & Lardner

[57] ABSTRACT

A warp beam flange assembly has a warp beam flange and a clamping ring. The clamping ring is releasably clamped, along with the flange, by at least two clamping screws onto a warp beam tube. To simplify manufacturing, the clamping ring is fastened by at least two axial fastening screws onto the flange outer surface and is supported directly on the flange outer surface by at least two rests. The rests are circumferentially offset from one another and form between them a clamping gap region in the shape of a segment of a circle. At least two axial clamping screws are circumferentially offset from each other and are located in the clamping gap region such that tightening the clamping screws in the clamping gap region reduces the space between the clamping ring and the flange outer surface and, as a result, induces flank pressure in a threaded engagement.

19 Claims, 2 Drawing Sheets

WARP BEAM FLANGE ASSEMBLY AND METHOD OF MANUFACTURE

BACKGROUND OF THE INVENTION

The invention relates to a warp beam flange. More specifically, the invention relates to a warp beam flange having a clamping ring which can be clamped using at least one clamping screw for releasable clamping of the flange and the ring to a warp beam tube. Warp beam flanges and tubes are used, for example, in the textile industry.

A warp beam flange is screwed onto externally threaded ends of a warp beam tube. The flange has to be secured against twisting at a desired axial distance from the flange at the other end of the tube. This securing is typically accomplished with a clamping ring, which is machined independently of the warp beam flange. The ring is provided with internal threads which screw onto the warp beam tube and is connected to the warp beam flange.

In one conventional design, the clamping ring has a radially slit clamping strap which is braced at its circumference by a clamping screw disposed approximately tangentially with respect to the warp beam tube. Fastening of this clamping strap to the warp beam flange is accomplished using fastening screws in the form of hexagonal socket screws, the heads of which bear up against the outer surface of the clamping strap.

In another conventional design, the clamping ring includes two clamping disks which are connected to each other by axial spacing webs which are machined separately from the warp beam flange and then fastened by fastening screws onto the outer flange surface of the warp beam flange. By bracing the two clamping ring halves against each other with the aid of clamping screws, a closure force is produced by flank pressure in the thread engagement between the clamping ring and the warp beam tube.

These conventional designs have a complex construction and are complicated to manufacture.

SUMMARY OF THE INVENTION

An object of the present invention is to provide a simplified warp beam flange assembly which is easier to manufacture.

Another object of the invention is to provide a warp beam flange assembly in which the flange and the clamp ring can be machined together.

According to one aspect of the invention, there is provided a warp beam flange assembly including a warp beam flange having a rest protruding from the surface of the flange and a clamping ring having a region contacting the rest and having a region separated from the surface of the flange by a clamping gap. A fastening screw holds the clamping ring in contact with the warp beam flange at the rest. A clamping screw is also provided. Tightening the clamping screw reduces the clamping gap to secure the warp beam flange assembly to a warp beam tube.

According to another aspect of the invention, there is provided a method for manufacturing a warp beam flange assembly. A warp beam flange having a rest protruding from the surface of the flange and a clamping ring having a region to contact the rest and having a region to be separated from the surface of the flange by a clamping gap are provided. The clamping ring is caused to contact the flange at the rest by tightening a fastening screw. Then, threads to receive a warp beam tube are machined in the warp beam flange and the clamping ring while they are fastened together.

Other objects, features, and advantages of the invention will be apparent from the detailed description of preferred embodiments of the invention set forth below.

BRIEF DESCRIPTION OF THE DRAWINGS

The invention will be described in further detail below with reference to the accompanying drawings, wherein.

DETAILED DESCRIPTION OF PREFERRED EMBODIMENTS

In the present invention, a clamping ring is fastened using at least two axial fastening screws onto a warp beam flange outer surface. The clamping ring is supported directly on the flange outer surface by at least two rests which are circumferentially offset with respect to each other. A clamping gap in the shape of a segment of a circle is formed between the rests. At least two axial clamping screws are arranged circumferentially offset from each other in the vicinity of the clamping gaps such that tightening the clamping screws reduces the axial space between the clamping ring and the flange outer surface and, as a result, induces a flank to press into the threads on a warp beam tube. The term "screw" as used herein means any type of threaded fastener.

A significant advantage of the present invention over conventional designs is that an unmachined clamping ring can be connected to the warp beam flange and then machined together with the flange. This assembly thus undergoes machining as a flange/clamping ring unit, which is then screwed onto the external threads of a warp beam tube and secured against twisting by tightening clamping screws.

In order to precisely and securely locate the flange assembly on the warp beam tube by flank pressure, three clamping screws are typically provided, offset with respect to one another by 120 circumferential degrees. In this design, each fastening screw is led through one of three rests which are offset with respect to one another by 120 circumferential degrees.

The rests can be shaped in a rib form or can have a round design. In the latter case, each fastening screw is preferably led through a rest. The rests can be provided on the rear side of the clamping ring. However, for manufacturing reasons, it is typically simpler to provide or cast the rests on the flange outer surface.

To reduce air turbulence, it is advantageous to have the clamping ring lie within an annular groove in the flange outer surface so that the ring is flush with the flange outer surface. All of the screw heads are countersunk in the clamping ring.

Figure 1:
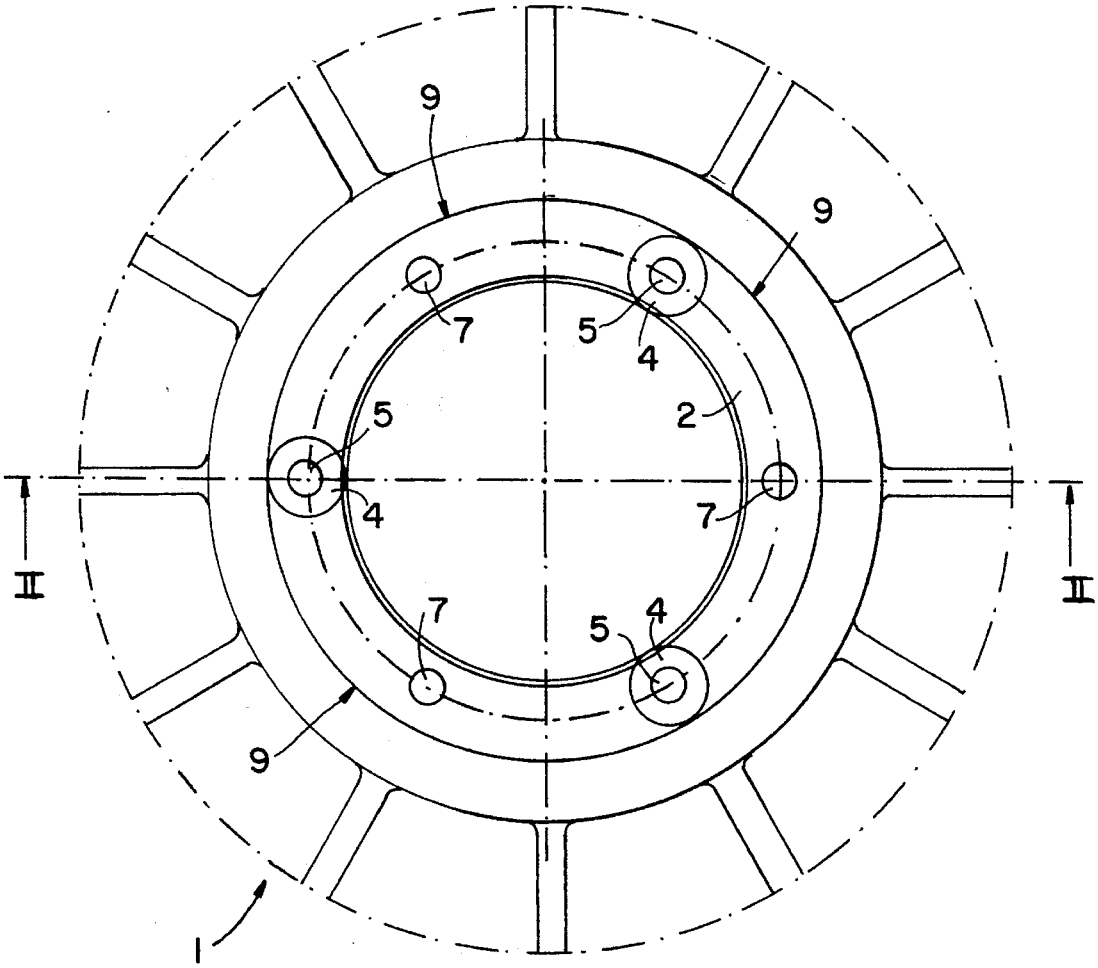
FIG. 1 is a plan view of a warp beam flange according to one embodiment of the invention.
Figure 2:
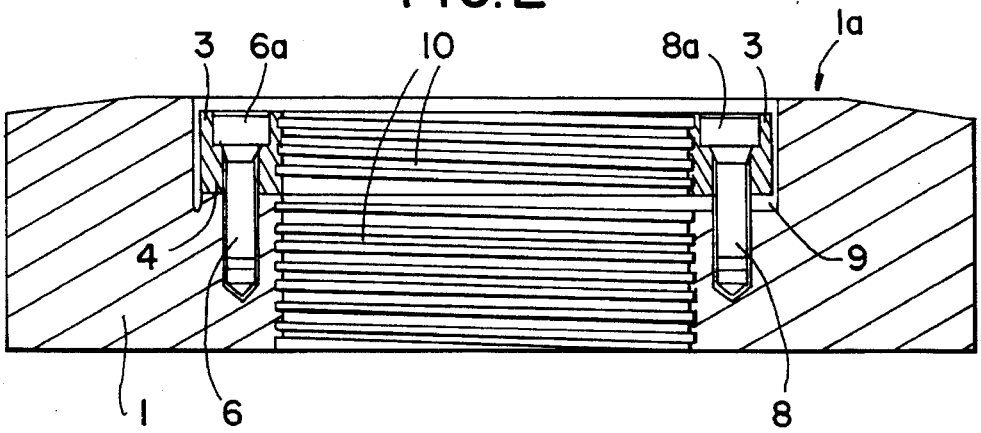
FIG. 2 is a cross-sectional view of the warp beam flange of FIG. 1 taken along line II of FIG. 1, along with installed clamping ring.

FIGS. 1 and 2 illustrate the detailed design of one embodiment of the invention. FIG. 1 illustrates a flange outer surface la of a warp beam flange 1 which is to be screwed onto external threads of a warp beam tube (not shown). The flange 1 is cast and has an annular groove 2 which receives a clamping ring 3, as shown in FIG. 2. (In FIG. 1 clamping ring 3 is omitted for clarity.)

In the bottom of the annular groove 2, three rests 4 are provided which are offset from each other by 120 circumferential degrees. The rests protrude from the surface of the flange. In this particular embodiment, the rests have a round design and are 2 to 4 mm high, although other geometries and dimensions can be used. Each rest 4 encloses a precast threaded hole 5 which receives a fastening screw 6. A precast threaded hole 7 is provided between adjacent rests to receive a clamping screw 8.

The clamping ring 3 in the annular groove 2 lies on the three rests 4 and between the rests 4 an open axial space exists between the bottom of the clamping ring 3 and the annular groove 2. This space is referred to herein as clamping gap 9. Each of the three clamping gaps extends in the shape of a segment of a circle between two rests 4.

The clamping ring 3 is secured with the aid of fastening screws 6 in the annular groove 2 and is thereby drawn firmly against the rests 4. After the clamping ring is secured to the flange 1, the flange 1 and the clamping ring 3 can be machined together in one set-up. This allows producing in a single machining operation the inner bore of the flange/ring assembly which extends through the flange 1 and the clamping ring 3 for internal threads 10. The warp beam flange 1, together with the clamping ring 3, can then be later screwed onto external threads of the warp beam tube.

To fix the warp beam flange 1 onto the warp beam tube three clamping screws 8 are screwed into corresponding threaded holes 7 and are tightened to such an extent that in the clamping gap region the space 9 between clamping ring 3 and the flange surface is reduced and, as a result, flank pressure is induced in the thread engagements between warp beam flange 1 and/or the clamping ring 3 and the warp beam tube.

As illustrated in FIG. 2, all of the screw heads 6*a* and 8*a* are countersunk in the clamping ring 3.

Figure 3:
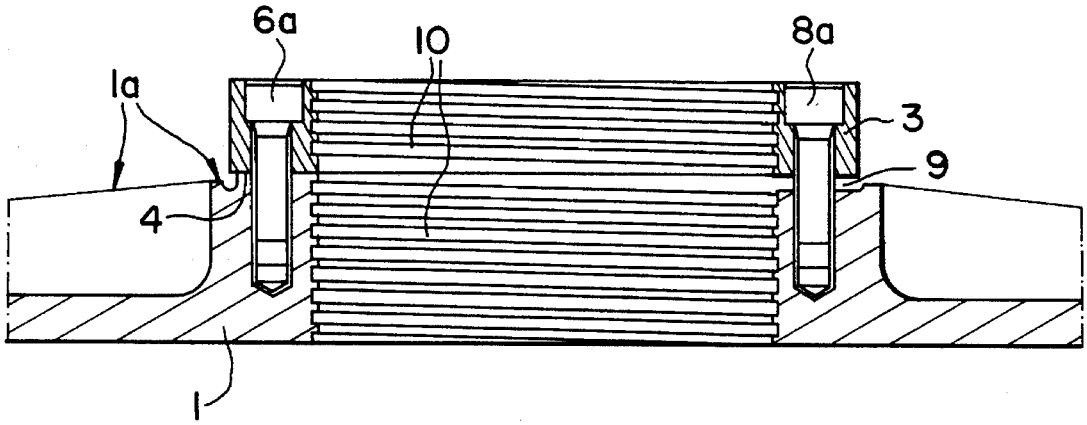
FIG. 3 is a cross-sectional view of a warp beam flange assembly according to another embodiment of the invention.

FIG. 3 illustrates another embodiment of the present invention. The embodiment of FIG. 3 differs from that of FIGS. 1 and 2 in that the clamping ring 3 is not located in an annular groove of the flange. Instead, the clamping ring 3 lies on rests 4 protruding slightly beyond the flange outer surface 1*a*.

In the warp beam flange assembly of the present invention, separate machining of the clamping ring and the flange is not required. After the combined machining of the flange along with its clamping ring, the warp beam flange assembly is ready to install (apart from surface treatment). As a result, exact concentricity with the warp beam tube is ensured. In addition, the machining costs are lower and consequently the entire product is less expensive. Even already existing configurations can be converted to the design of the present invention at low cost.

The exemplary embodiments described above permit easy exchange of the clamping ring due to the two-part flange/clamping ring design. The clamping ring can be cast onto the flange, but otherwise retain the features described above. This design may require considerably more casting material and consequently result in an increase in the weight of the flange assembly. In addition, in such a design, there is no longer the advantage of exchangeability of the clamping ring.

Although the invention has been described above with reference to certain specific embodiments of the invention, the present invention is not limited to the specific embodiments described above. Variations and modifications of the above-described embodiments within the spirit of the invention will occur to those skilled in the field after receiving the above teachings. The scope of the invention is therefore defined by the following claims.

What is claimed is:

1. A warp beam flange assembly comprising:

a warp beam flange having an annular groove and a rest protruding from the surface of the annular groove;

a clamping ring located in the annular groove, the clamping ring having a region contacting the rest and having a region separated from the surface of the annular groove by a clamping gap;

a fastening screw to hold the clamping ring in contact with the warp beam flange at the rest; and a clamping screw whose tightening reduces the clamping gap to secure the warp beam flange assembly to a warp beam tube.

2. A warp beam flange assembly as set forth in claim 1, further comprising a hole through the rest to receive the fastening screw.

3. A warp beam flange assembly as set forth in claim 1, further comprising a hole in the flange adjacent the clamping gap to receive the clamping screw.

4. A warp beam flange assembly as set forth in claim 1, wherein the clamping gap has the shape of a segment of a circle.

5. A warp beam flange assembly comprising:

a warp beam flange having a rest protruding from the surface of the flange;

a clamping ring having a region contacting the rest and having a region separated from the surface of the flange by a clamping gap;

a fastening screw to hold the clamping ring in contact with the warp beam flange at the rest; and a clamping screw whose tightening reduces the clamping gap to secure the warp beam flange assembly to a warp beam tube.

6. A warp beam flange assembly as set forth in claim 5, further comprising a hole through the rest to receive the fastening screw.

7. A warp beam flange assembly as set forth in claim 5, further comprising a hole in the flange adjacent the clamping gap to receive the clamping screw.

8. A warp beam flange assembly as set forth in claim 5, wherein the clamping gap has the shape of a segment of a circle.

9. A warp beam flange assembly comprising:

a warp beam flange;

a clamping ring clamped by at least one clamping screw for releasable clamping of the flange, screwed together with the clamping ring, onto a warp beam tube, the clamping ring contacting a flange outer surface via at least two rests which are arranged circumferentially offset from each other;

at least two axial fastening screws to secure the clamping ring to the flange, the fastening screws forming between them a clamping gap region in the shape of a segment of a circle; and at least two clamping screws circumferentially offset from each other in a clamping gap region such that tightening the clamping screws reduces a clamping gap between the clamping ring and the flange outer surface to induce flank pressure in a thread engagement between the warp beam flange assembly and a warp beam tube.

10. A warp beam flange assembly as set forth in claim 9, wherein each fastening screw is led through a rest.

11. A warp beam flange assembly as set forth in claim 9, comprising three rests offset with respect to one another by 120 circumferential degrees.

12. A warp beam flange assembly as set forth in claim 9, comprising three clamping screws offset with respect to one another by 120 circumferential degrees.

13. A warp beam flange assembly as set forth in claim 9, wherein an axial height of the rests is 2 to 4 mm.

14. A warp beam flange assembly as set forth in claim 9, comprising threaded holes for the fastening and clamping screws precast in the flange.

15. A warp beam flange assembly as set forth in claim 9, wherein the rests are provided on the flange outer surface.

16. A warp beam flange assembly as set forth in claim 9, wherein screw heads of the fastening and clamping screws are countersunk in the clamping ring.

17. A warp beam flange assembly as set forth in claim 9, wherein the clamping ring lies within an annular groove of the flange.

18. A method for manufacturing a warp beam flange assembly comprising the steps of:

(a) providing a warp beam flange having a rest protruding from the surface of the flange;

(b) providing a clamping ring having a region to contact the rest and having a region to be separated from the surface of the flange by a clamping gap;

(c) causing the clamping ring to contact the flange at the rest by tightening a fastening screw; and (d) machining threads to receive a warp beam tube in the warp beam flange and the clamping ring while they are fastened together.

19. A method as set forth in claim 18, further comprising the step of tightening a clamping screw to reduce the clamping gap and secure the warp beam flange assembly to a warp beam tube.

* * * * *